US008508132B1

(12) United States Patent
Andreev et al.

(10) Patent No.: US 8,508,132 B1
(45) Date of Patent: Aug. 13, 2013

(54) METAMATERIAL CATHODES IN MULTI-CAVITY MAGNETRONS

(75) Inventors: Andrey D. Andreev, Albuquerque, NM (US); Kyle J. Hendricks, Albuquerque, NM (US)

(73) Assignee: The United States of America as Represented by the Secretary of the Air Force, Washington, DC (US)

( * ) Notice: Subject to any disclaimer, the term of this patent is extended or adjusted under 35 U.S.C. 154(b) by 303 days.

(21) Appl. No.: 13/036,687

(22) Filed: Feb. 28, 2011

(51) Int. Cl.
*H01J 25/50* (2006.01)

(52) U.S. Cl.
USPC ..... 315/39.51; 315/39.75

(58) Field of Classification Search
USPC ..... 315/39, 39.51, 39.71, 39.75, 39.77
See application file for complete search history.

(56) References Cited

U.S. PATENT DOCUMENTS

| | | | | |
|---|---|---|---|---|
| 5,146,136 | A * | 9/1992 | Ogura et al. | 315/39.69 |
| 5,159,241 | A * | 10/1992 | Kato et al. | 315/39.51 |
| 5,552,672 | A * | 9/1996 | Rosenberg | 315/39.51 |
| 7,245,082 | B1 * | 7/2007 | Fleming | 315/39.67 |
| 7,696,696 | B2 | 4/2010 | Fuks | |
| 7,893,621 | B2 * | 2/2011 | Schamiloglu et al. | 315/39.51 |
| 8,018,159 | B2 * | 9/2011 | Fuks et al. | 315/39.51 |
| 2005/0225247 | A1 * | 10/2005 | Mulcahy et al. | 315/39.51 |

OTHER PUBLICATIONS

Metamaterial Cathodes in Multicavity Magnetrons, Nov. 2010 Am. Phy. Soc./Div of Plasma Physics, presentation.

* cited by examiner

*Primary Examiner* — Tung X Le
(74) *Attorney, Agent, or Firm* — James M. Skorich; Kenneth E. Callahan

(57) ABSTRACT

Bulk metamaterial cathodes for multi-cavity magnetrons characterized by specific metal-thin-wire medium lattice topologies are used to improve the magnetron output characteristics, including faster startup times and higher microwave radiation powers.

15 Claims, 16 Drawing Sheets

Cylindrical Coordinates
ρ – radial distance
ϕ – azimuth angle
z - height

Smooth Solid Cylindrical Cathode
(Prior Art)

Helical Cathode With
Back-current Electrode
(Prior Art)

Shaped Cathode
(Prior Art)

Thin Walled Tubular Cathode
(Prior Art)

| Steady-state Output Parameters | Solid Cathode (FIG. 4) | Transparent Cathode (FIG. 7) | Rodded Quasi-Metamaterial Cathode (FIG. 3, 10) |
|---|---|---|---|
| Anode Current (A) | 7.7 | 16.7 | 23.1 |
| Output Power (kW) | 310.8 | 621.0 | 819.7 |
| Squared Resonator Voltage (kVxkV) | 521.6 | 1015 | 1324 |
| Electronic Efficiency (%) | 89.3 | 82.5 | 78.8 |
| Operating Frequency (MHz) | 889.5 | 889.5 | 889.5 |

METAMATERIAL CATHODES IN MULTI-CAVITY MAGNETRONS

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

BACKGROUND OF THE INVENTION

The present invention generally relates to using metamaterial structures in high-power microwave vacuum electron devices and more particularly, it relates to using the metal-thin-wire medium as an electron emitter in multi-cavity magnetrons. The metal wires are thin in relation to the wavelength of the magnetron operation only. The actual thickness of the metal wires may be as large as necessary for handling the appropriate thermal loads within the multi-cavity magnetrons.

The multi-cavity magnetron may be considered as a cylindrical magnetron diode with the cathode emitting electrons and the anode consisting of a number of resonant cavities. The cavities slow down the circumferential component of the electromagnetic wave, which azimuthally travels between the cathode and the anode. The traveling electromagnetic wave is associated with the radio frequency (rf) electric field induced within the magnetron. The external DC electric field $E_0$ in the magnetron diode is directed radially from the anode to the cathode. The external DC magnetic field $H_0$ is directed axially. The crossed external DC electric and magnetic fields ($E_0 \times H_0$) force the electrons emitted from the cathode to drift in the azimuthal direction. This drift forms the electron space-charge cloud surrounding the cathode. The multi-cavity magnetron starts to generate (induce) the rf electric field and produce microwaves (output power) when the azimuthal drift velocity of the emitted electron is approximately equal to the phase velocity of the circumferential component of the electromagnetic wave traveling in the same azimuthal direction.

The operating mode of the multi-cavity magnetron is the transverse-electrical-like (TE-like) mode of the magnetron resonant cavity. The resonant cavity is formed by the cathode and the anode of the magnetron. The frequency of the magnetron operation is determined by: (i) the geometry of the resonant cavity; (ii) the relation between the external DC electric and magnetic fields; and (iii) the amount of the space charge accumulated within the electron flow rotating between the cathode and the anode. The spatial distribution of the induced rf electromagnetic field within the resonant cavity is characterized by the TE-like mode pattern. This pattern is characterized by the circumferential $E_{1\Phi}$ and the radial $E_{1\rho}$ components of the electric field and the axial $H_{1z}$ component of the magnetic field. The number of the phase variations of the induced rf electric field in the azimuthal direction is determined by the operating frequency of the magnetron (mode of the magnetron operation) and the anode geometry (number of cavities). The number of the induced rf electric field phase variations along the radius and the axis of the resonant system are minimized. This allows the magnetron to operate in the lower-frequency TE-like mode and prevents both the axial and the radial modes competing.

Cathode priming of multi-cavity magnetrons results in faster start-up times, locking of the magnetron oscillations into the desired magnetron operating mode, and increasing the total radiated microwave power/energy. Among earlier methods of cathode priming are: (i) the artificial selection of the emitting regions on a surface of a solid cylindrical cathode (the PAL cathode of the University of Michigan); (ii) change of a geometrical shape of the solid cylindrical cathode (the shaped cathode of the U.S. Pat. No. 7,245,082 B1, Jul. 17, 2007), FIG. 6; and (iii) removal of longitudinal strips from a thin-walled tubular cathode (the transparent cathode of U.S. Pat. No. 7,696,696 B2, Apr. 13, 2010), FIG. 7. A new method of cathode priming of multi-cavity magnetrons using metamaterial structure as a unique cathode design is presented here resulting in improved output characteristics.

SUMMARY

The unique cathode designs using metamaterials for multi-cavity magnetrons of the present invention result in faster start-up times, locking of the magnetron oscillations into the desired magnetron operating mode, and increasing the total radiated microwave power/energy. The metamaterial cathodes are made of a metal-thin-wire (MTW) medium characterized by a specific MTW lattice topology. When individual elements of the MTW medium are oriented parallel to a non-zero component, either azimuthal or radial, of the rf electric field induced within the magnetron, the MTW medium will exhibit metamaterial properties by proper selection of the wire geometry and the MTW lattice topology. If the individual elements of the MTW medium are oriented longitudinally, the MTW medium becomes a quasi-metamaterial (rodded) medium that is transparent to both the azimuthal and the radial components of the induced rf electric field. The negative or zero permittivity $\epsilon$ and/or the permeability $\mu$ of these cathodes significantly modify the induced rf electric field distribution within the magnetron's resonant system with a corresponding change of its dispersion diagram. These metamaterial cathodes facilitate faster startup of microwave oscillations and either artificial selection or intentional dumping of either desired or undesired magnetron operating modes.

DESCRIPTION OF THE PREFERRED EMBODIMENT

Figure 1:
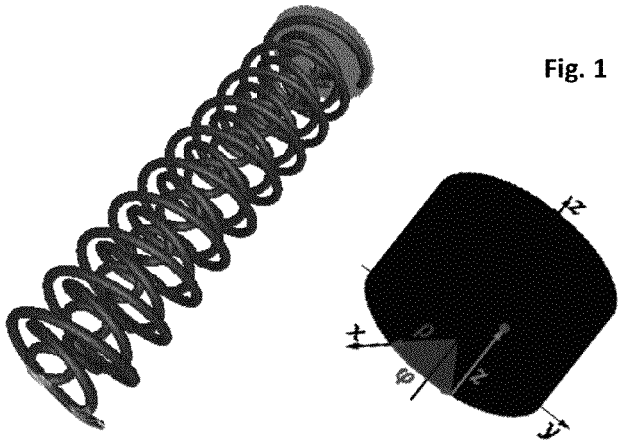
FIG. 1 is a metamaterial cathode with metal-thin-wire structures oriented parallel to the azimuthal component of the induced rf electric field $E_\Phi$.

A metamaterial is an artificial macroscopic composite with a periodic lattice structure which produces several responses, not available in nature, to a specific excitation.

The metamaterial cathode (meta-cathode) of a multi-cavity magnetron may be defined as the electron source made of a bulk metamaterial. There are two designs of the present state-of-the-art metamaterials. These are the three-dimensional arrays or lattices of the metal-thin-wire (MTW) medium and the metal-split-ring (MSR) medium. Both designs are characterized by the distance between two adjacent wires a (lattice parameter) and the wire diameter d. The MTW/MSR medium may be considered as a metamaterial structure. The constitutive parameters of the metamaterial structure, negative-$\epsilon$/positive-$\mu$ and positive-$\epsilon$/negative-$\mu$, respectively, are functions of the induced rf electric and/or magnetic fields. The following conditions should be satisfied. The lattice parameter of the metamaterial structure is less than quarter of the wavelength $\lambda$ of the induced rf field, $a<\lambda/4$. The wire diameter of the metamaterial structure is less than the lattice parameter, $d<a$. There should be a situation where either induced rf electric field $E_1$ oscillates along the wires of the metamaterial structure, or the induced rf magnetic $H_1$ field oscillates perpendicular to the rings of the MSR structure. The actual lattice parameters a, the wire diameter d, and the induced rf electric and/or magnetic fields orientation ($E_1 \times H_1$) with respect to a particular metamaterial structure can only be determined by numerical simulations that are within the capabilities of those with ordinary skill in the art.

The induced rf electromagnetic fields ($E_1 \times H_1$) induce electrical currents to oscillate within the individual metal wires of the metamaterial structure. Those oscillations generate an artificial electric or magnetic dipole moment, respectively, within the metamaterial structure. The dipole moment either constructively or negatively interacts with the induced $E_1$'$H_1$ fields. The net result of such an interaction is the modification of the stop/pass bands locations on the dispersion diagram of a resonant cavity where the metamaterial structure is situated. Thus, the dispersion diagram of the resonant system is modified by the metamaterial structures. The MTW/MSR medium may be considered as quasi-metamaterials (transparent medium) when the induced rf electric field is orthogonal to the individual wires of the MTW/MSR medium and freely penetrates inside of those structures. The diagram of the resonant system is modified as well by the quasi-metamaterial structures.

For example, there is one, z-component of the induced rf electric field, $E_{1z}$, and this electric field component is directed parallel to the axis of the wires of the MTW medium, which is, accordingly, the z-axis. In this case, the corresponding principal permittivity, $\epsilon_{zz} \equiv \epsilon_z$, is negative, and the other two, $\epsilon_x$ and $\epsilon_y$, are positive and can be as small as the permittivity of free space $\epsilon_0$. All entries of the permittivity tensor may be varied by changing the lattice parameter a and the wire diameter d of the MTW medium. In the general case, when all three components of the induced rf electric field are oblique with respect to the wires of the MTW medium, all the entries of the permittivity tensor $\epsilon_{ij}$ are either negative or positive or close to the permittivity of the free space. The exact values of the entries of the permittivity tensor $\epsilon_{ij}$ depend on the orientation of the axes of the wires with respect to the induced rf electric field, the lattice parameter a, and the geometry/dimension of the wires d.

One embodiment of the invention is to use the metal-thin-wire (MTW) and the metal-split-ring (MSR) mediums as the meta-cathodes in the multi-cavity magnetrons. The term "thin-wire" is used as a matter of convention. This is because it reflects the relation between the wire diameter d and the wavelength $\lambda$ of the magnetron operating mode only. The actual diameter of the metallic elements (wires) of the MTW/MSR medium may be as big as necessary to handle the particular magnetron cathode currents and thermal loads. The metallic elements of the MTW/MSR medium should hence be small enough compared to the wavelength of the rf electromagnetic field induced within the magnetron resonant system. Additionally, the MTW/MSR medium may not necessarily be made of pure metal. Instead, the individual elements of the MTW/MSR medium may be made of or covered by specially developed explosive-emission-friendly and high-conductive materials (graphite, carbon fibers, etc.). Those materials allow for low threshold and reduced yield of the explosive-emission plasma. In some cases the MTW/MSR medium may even be made of dielectric materials which are conductive in certain frequency ranges.

The meta-cathode made of the MTW/MSR medium is placed into the center of the magnetron resonant system. The metamaterial cathodes of FIG. 1-3 correspond to the cross-sections of the magnetron resonant systems shown in FIG. 8-10, respectively. The MTW/MSR medium modifies the dispersion diagram of the magnetron resonant system. This modification corresponds to the change of the pass/stop band locations and the resonant frequencies of the dispersion diagram. The variation of the lattice parameter a, the individual wire diameter d, and the overall bulk geometry of the MTW/MSR medium allows for controlled modification of the dispersion diagram. This also allows for the controlled selection of the magnetron operating mode and/or damping of the undesired neighborhood modes. The use of the MTW/MSR medium in multi-cavity magnetrons results in the extension of the range of the input voltages and external magnetic fields at which the magnetron effectively operates in the desired mode.

Figure 8:
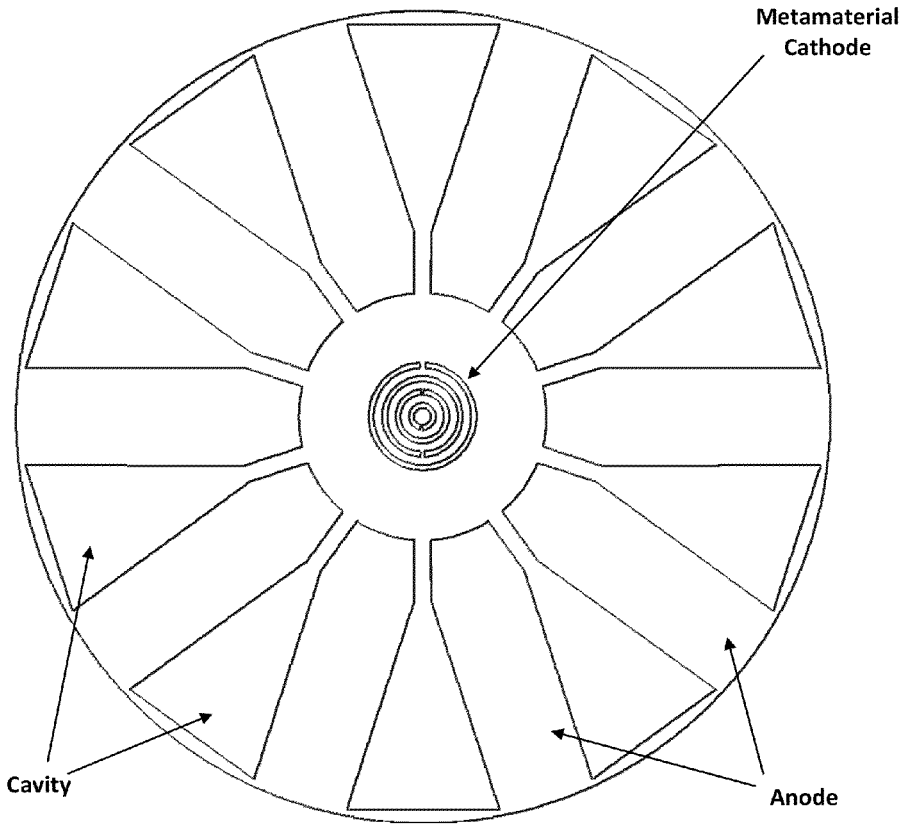
FIG. 8 is a cross-section of the resonant system of the CTL CWM 75/100L magnetron with the metamaterial cathode made of metal-thin-wire structures oriented parallel to the circumferential component of induced rf electric field $E_\Phi$ (FIG. 1 Cathode).

The meta-cathode made of the MTW/MSR medium may be designed a number of different ways. A multi-cavity magnetron may be viewed as a centrally located electron-emitting cathode symmetrical with respect to the longitudinal axis surrounded by a symmetrical anode having a plurality of resonant cavities. An external DC electric field $E_0$ is directed radially from the anode to the cathode ($-\rho$) and an external DC magnetic field $H_0$ is directed parallel to the longitudinal axis (z). During operation an electromagnetic field ($E_1 \times H_1$) is induced within the magnetron. This induced electromagnetic field has a circumferential component $E_{1\Phi}$, radial component $E_{1\rho}$, and an axial component $H_{1z}$. One embodiment of a meta-cathode structure is comprised of one or more nested helical structures. Each helical structure forms a metal-thin-wire metamaterial lattice with a wire directed generally parallel to the circumferential component $E_{1\Phi}$ of the induced rf electric field. Each helical structure is formed as a set of metal-split-ring resonators that are generally oriented in a plane perpendicular to the axial component $H_{1z}$ of the induced rf magnetic field. Each individual element (helical structure) of this meta-cathode is formed as a set of metallic split rings that are electrically connected to each other. Furthermore, if the distance between two adjacent wires is a and the wire diameter is d, then the following conditions should be met: $a<\lambda/4$ and $d<a$ where $\lambda$ is the wavelength of the induced rf electric field. An example of this meta-cathode is shown in FIG. 1 and FIG. 8. In these figures, the meta-cathode consists of four helixes, each nested inside the other.

Such a geometry of the MTW/MSR medium allows (i) the circumferential component of the induced rf electric field to oscillate along the thin wires, which induces an artificial electric dipole moment, and (ii) the axial component of the induced rf magnetic field to oscillate perpendicular to the plane of the split rings, which induces an artificial magnetic dipole moment within the body of the metamaterial cathode. The metamaterial cathode may be made either as single helix or as number of helical structures (double or triple helix). Those structures are placed either inside of each other (Matryoshka principle) or within each other at the center of the magnetron resonant system.

Figure 2:
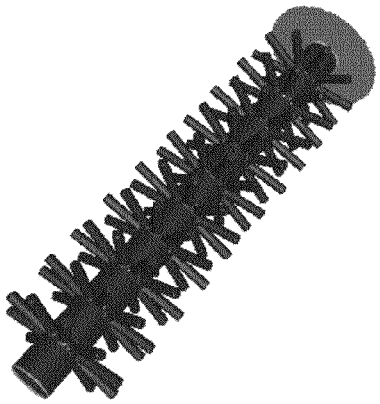
FIG. 2 is a metamaterial cathode with metal-thin-wire structures oriented parallel to the radial component of the induced rf electric field $E_\rho$.
Figure 9:
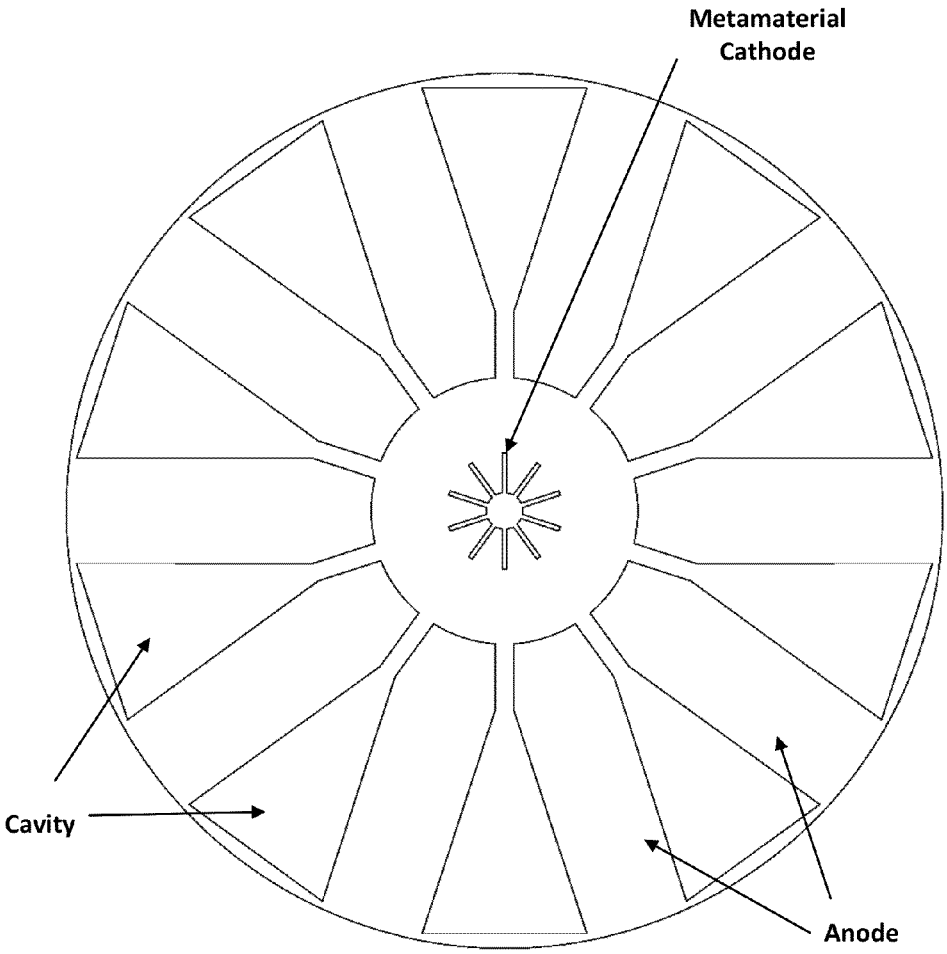
FIG. 9 is a cross-section of the resonant system of the CTL CWM 75/100L magnetron with the metamaterial cathode made of metal-thin-wire structures oriented parallel to the radial component of induced rf electric field $E_\rho$ (FIG. 2 Cathode)

Another possible design of the meta-cathode is shown in FIG. 2 and FIG. 9. In this case, the individual elements of the MTW medium are oriented parallel to the radial component $E_{1\rho}$ of the induced rf electric field, i.e., directed from the central electrode toward the anode in the radial direction. The length, the number, and the distance between the individual elements of the MTW medium may vary. This design of the meta-cathode corresponds, to some extent, to the multi-point cathode developed as an alternative to the conventional solid cathode.

Figure 3:
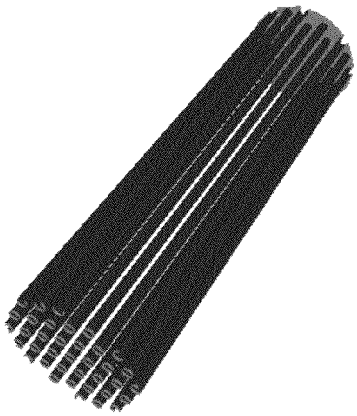
FIG. 3 is a metamaterial cathode with metal-thin-wire structures oriented parallel to the axial component of the induced rf electric field $E_z$.
Figure 10:
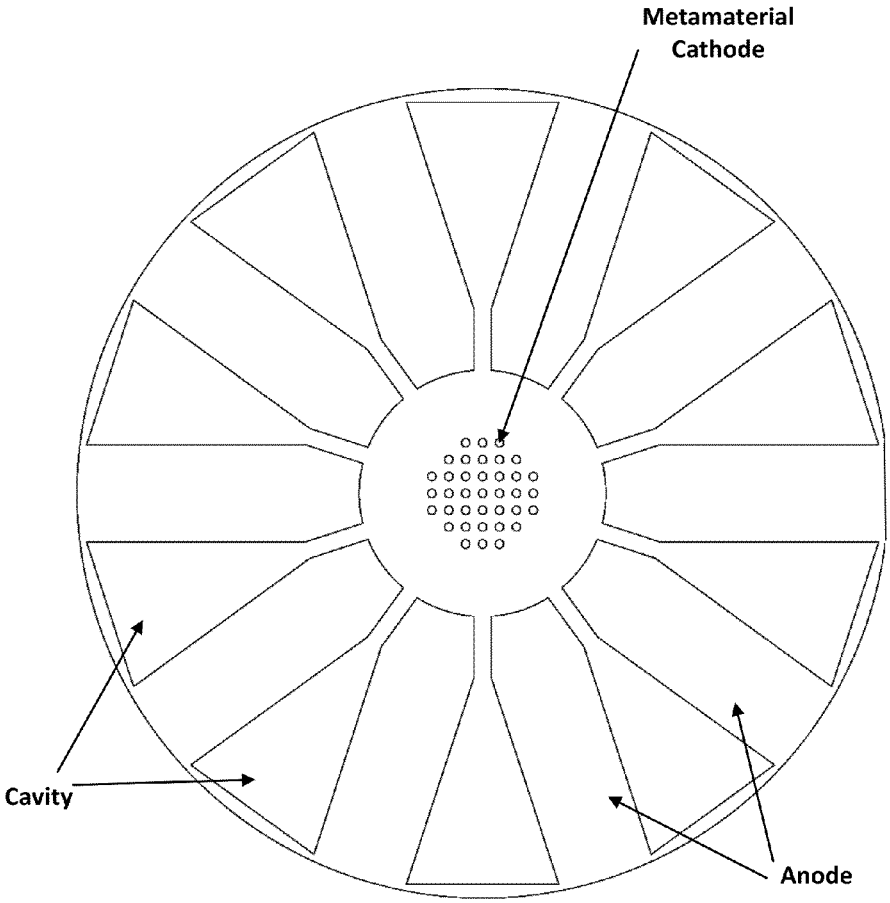
FIG. 10 is a cross-section of the resonant system of the CTL CWM 75/100L magnetron with the metamaterial cathode made of metal-thin-wire structures oriented parallel to the axial component of the induced rf electric field $E_z$ (FIG. 3 Cathode).

One more design of the meta-cathode is shown in FIG. 3 and FIG. 10. This particular geometry of the MTW medium is formed by the plurality of individual wires (rods) directed parallel to the axis of the multi-cavity magnetron. In this case, all the individual elements of the MTW medium are perpendicular to both the circumferential $E_{1\Phi}$ and the radial $E_{1\rho}$ components of the induced rf electric field. They are also parallel to the axial component $H_{1z}$ of the induced rf magnetic field and to the axial component of the external DC magnetic field. There are no rf electric fields components oscillating along the metal thin wires. Because of this, this "rodded" cathode may be considered as a quasi-metamaterial cathode. The quasi-metamaterial (rodded) cathode of FIG. 3 is transparent to the induced rf electric field. This metamaterial rodded cathode was the subject of a presentation made in November 2010 during the American Physical Society/Division of Plasma Physic meeting (Andrey D Andreev, Kyle J Hendricks, "Metamaterial cathodes in multicavity magnetrons").

Figure 5:
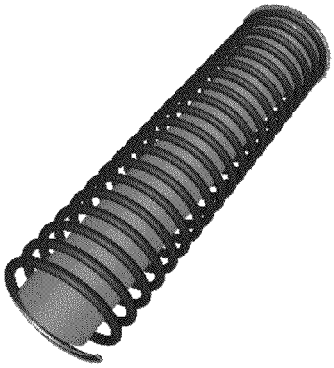
FIG. 5 is a helical cathode with a central buck current electrode (prior art).
Figure 6:
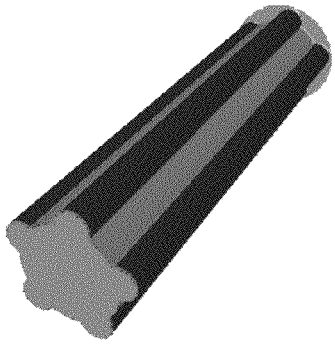
FIG. 6 is the shaped cathode of U.S. Pat. No. 7,245,082 (prior art).
Figure 7:
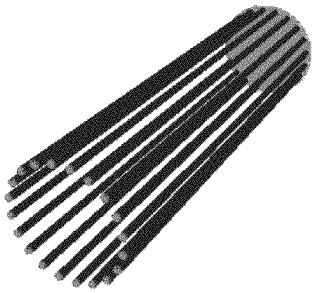
FIG. 7 is the transparent cathode of U.S. Pat. No. 7,696,696 (prior art).

The use of the meta-cathodes (FIG. 1-3) in the multi-cavity magnetrons, instead of the traditional smooth cylindrical cathode (FIG. 4) and the helical cathode with the central back-current electrode (FIG. 5) may be considered as the cathode priming of those magnetrons. Among other methods of cathode priming are: (i) the artificial selection of the emitting regions on a surface of a solid cylindrical cathode (the PAL cathode of the University of Michigan); (ii) change of a geometrical shape of the solid cylindrical cathode (the shaped cathode of the U.S. Pat. No. 7,245,082 B1, Jul. 17, 2007), FIG. 6; and (iii) removal of longitudinal strips from a thin-walled tubular cathode (the transparent cathode of U.S. Pat. No. 7,696,696 B2, Apr. 13, 2010), FIG. 7. The cathode priming of multi-cavity magnetrons results in faster start-up times, locking of the magnetron oscillations into the desired magnetron operating mode, and increasing the total radiated microwave power/energy.

The transparent cathode (FIG. 7) is the special case of the quasi-metamaterial rodded cathode made of a plurality of individual emitters (rods). These emitters are arranged along a circle of a given diameter parallel to the axis of the magnetron's resonant system (longitudinally). This construction may be considered as the quasi-metamaterial surface rolled up into a hollow cylinder of a given diameter.

The multi-point cathode is a special case of the metamaterial cathode made of a plurality of individual emitters (rods). These emitters are oriented parallel to the radial component $E_{1\rho}$ of the induced rf electric field.

Particle-in Cell Simulations Demonstrating the Effect of the Invention

The positive effect of the quasi-metamaterial cathode on the operation of the multi-cavity magnetron is demonstrated by simulations of the ten-cavity non-relativistic strapped magnetron whose geometrical and operational parameters are similar to the high-power industrial heating CWM 75/100L magnetron of California Tube Laboratory (CTL) operating in the UHF range and producing 75-100 kW of the continuous-wave (CW) microwave power with an efficiency near 90% (http://www.caltubelab.com/products/cwm.html). The simulations are performed using the ICEPIC code developed and maintained by the Air Force Research Laboratory (AFRL/RDHE). ICEPIC is a fully relativistic, three-dimensional, Cartesian, variable-mesh PIC (particle-in cell) code capable of simulating the interdisciplinary physics of charge-particle beams, high-power microwaves, and plasmas in complex geometries of modern microwave vacuum electronic devices.

Figure 4:
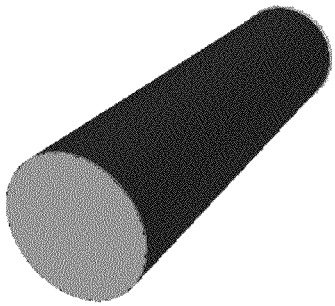
FIG. 4 is a traditional smooth cylindrical cathode (prior art).

The simulation model of the magnetron reflects all important features of a typical heavily-strapped high-power industrial heating and cooking UHF magnetron. It consists of (i) a cathode block with an input port, (ii) a 10-vane anode block surrounding the emitting part of the cathode block, (iii) a "double-ring-strapping" system coupling the alternative resonators of the anode block, and (iv) three output electrodes connecting three vanes of the anode block with the appropriate output ports. The most important geometrical dimensions of the simulation model of the magnetron are determined by the actual geometry of the CTL CWM 75/100L magnetron. The anode diameter is 2.92 cm, the anode length is 4.83 cm, the vane height is 3.18 cm, and the vane thickness is 1.15 cm. The cathode of the simulation model is of three different forms: (i) solid cathode (FIG. 4); (ii) the thin-walled tubular transparent cathode FIG. 7); and (iii) the quasi-metamaterial rodded cathode (FIG. 3 and FIG. 10). The outer diameter of all those cathodes is the same, 1.27 cm, and the cathode length is the same as the length of the anode. Simulations of the CTL CWM 75/100L magnetron operation with three different cathodes are done at the same input voltage $V_0$=45 kV, and the same external magnetic flux density $B_0$=0.49 T.

Figure 12A:
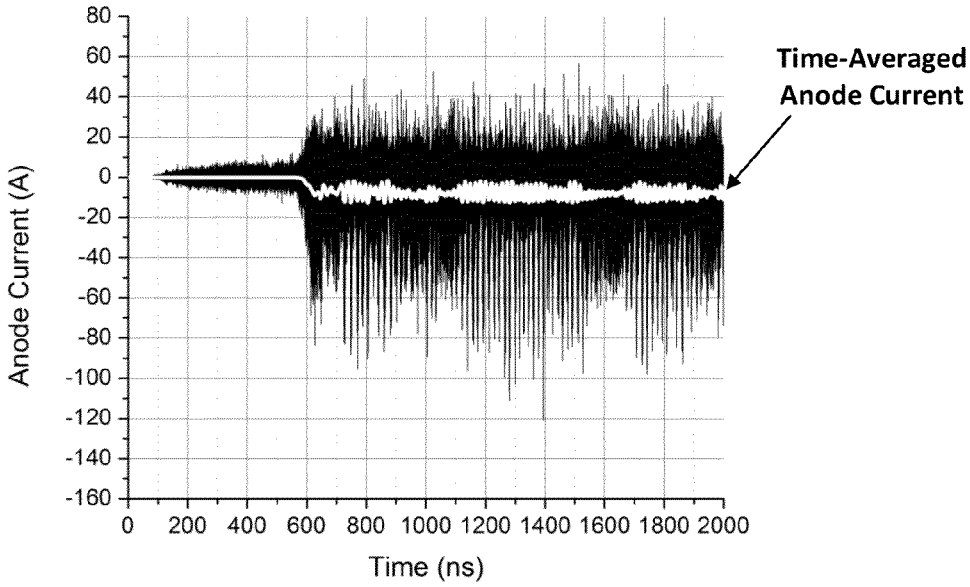
FIG. 12a (Prior Art)
FIG. 12*a* shows a plot of the anode current (ICEPIC simulations) of the CTL CWM 75/100L magnetron with the solid cathode of FIG. 4 (prior art).
Figure 12B:
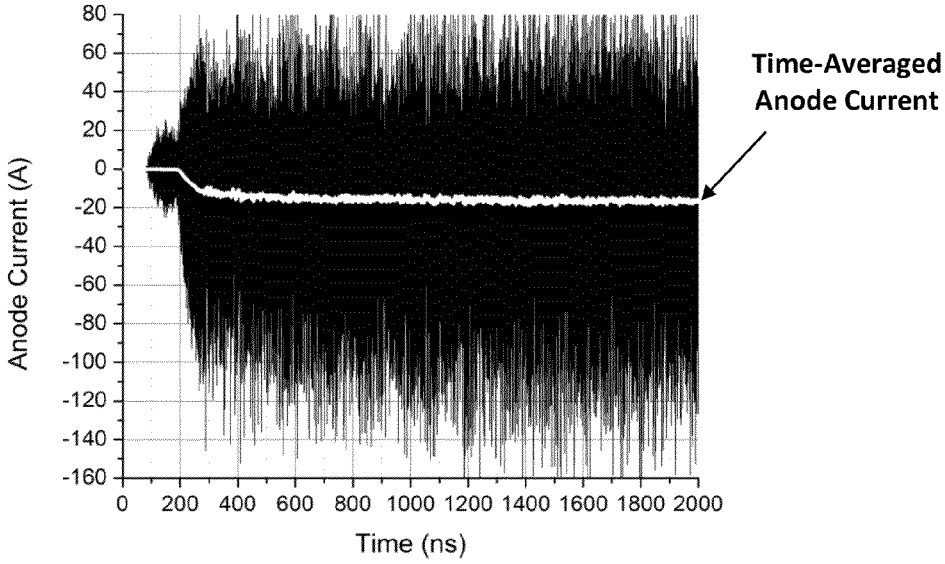
Fig. 12b (Prior Art)
FIG. 12*b* shows a plot of the anode current (ICEPIC simulations) of the CTL CWM 75/100L magnetron with the transparent cathode of FIG. 7 (prior art).
Figure 12C:
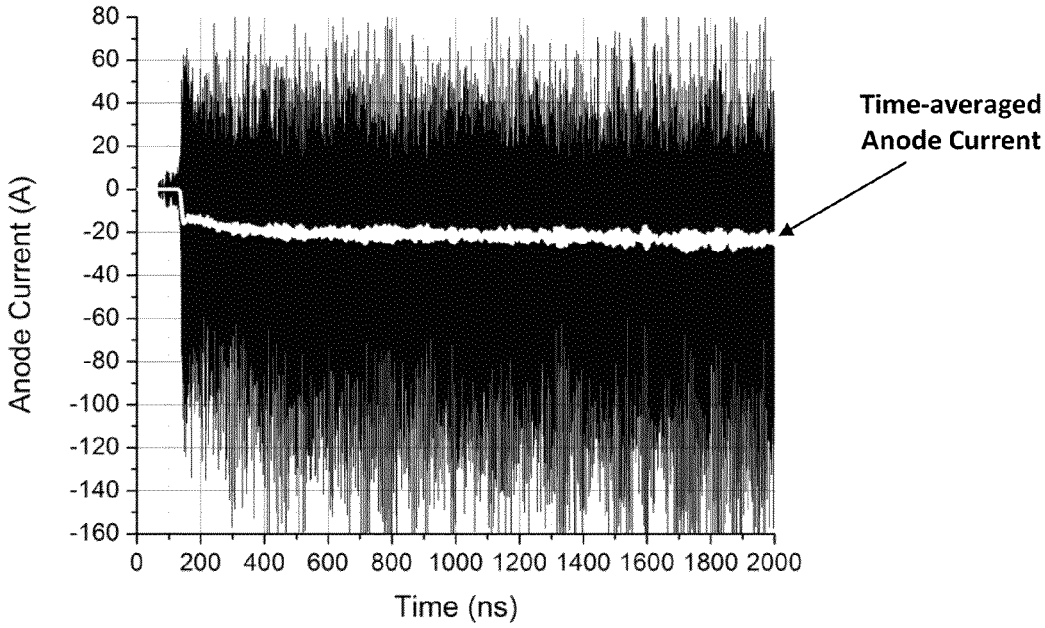
FIG. 12*c* shows a plot of the anode current (ICEPIC simulations) of the CTL CWM 75/100L magnetron with the metamaterial rodded cathode of FIG. 3, 10.
Figure 13A:
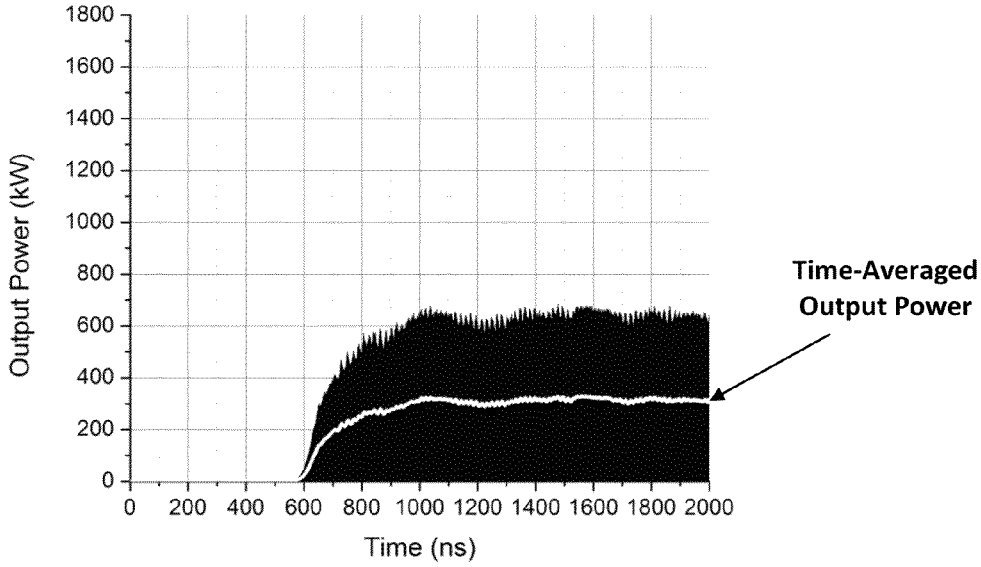
FIG. 13a (Prior Art)
FIG. 13*a* is a plot of the output power (ICEPIC simulations) of the CTL CWM 75/100L magnetron with the solid cathode of FIG. 4 (prior art).
Figure 13B:
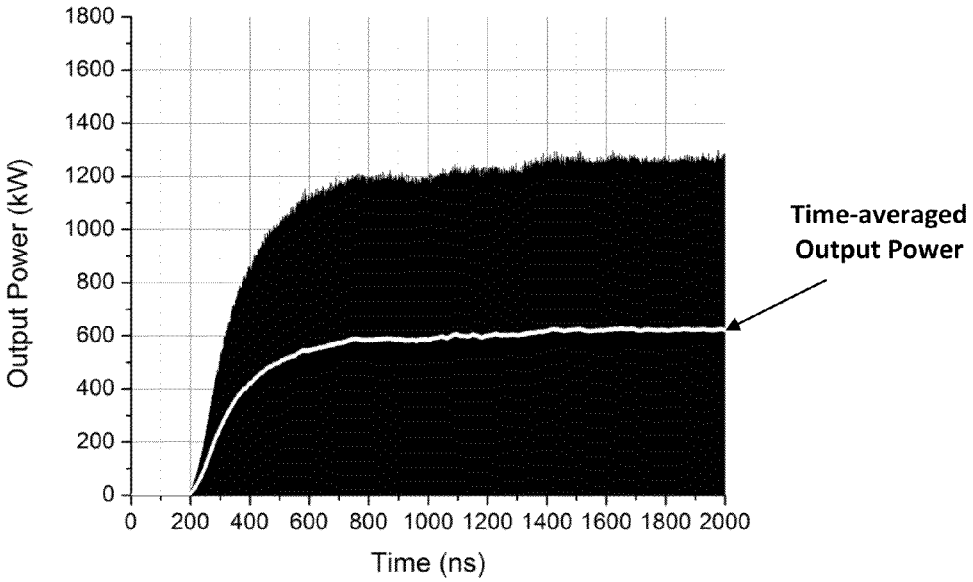
FIG. 13b (Prior Art)
FIG. 13*b* is a plot of the output power (ICEPIC simulations) of the CTL CWM 75/100L magnetron with the transparent cathode of FIG. 7 (prior art).
Figure 13C:
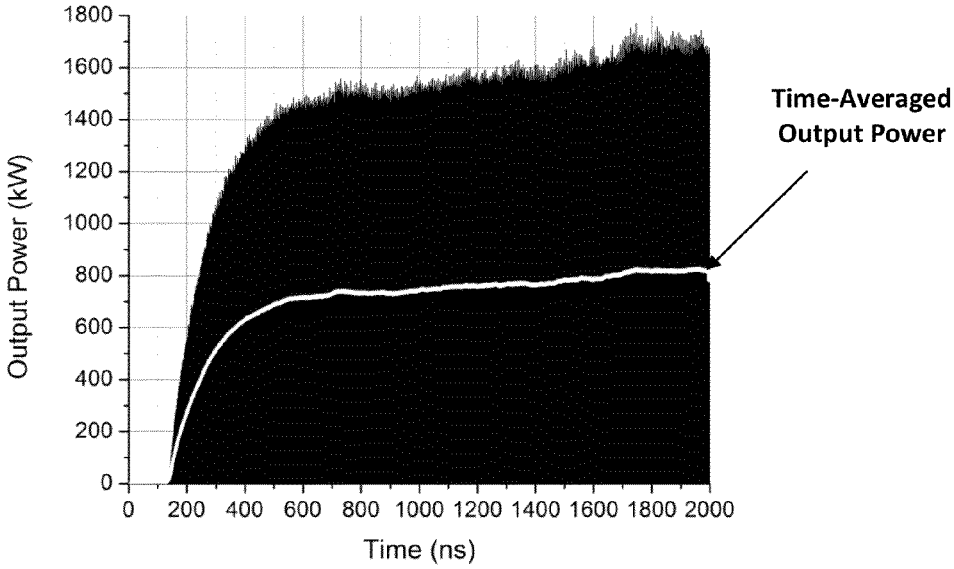
FIG. 13*c* is a plot of the output power (ICEPIC simulations) of the CTL CWM 75/100L magnetron with the metamaterial rodded cathode of FIG. 3, 10.
Figure 14A:
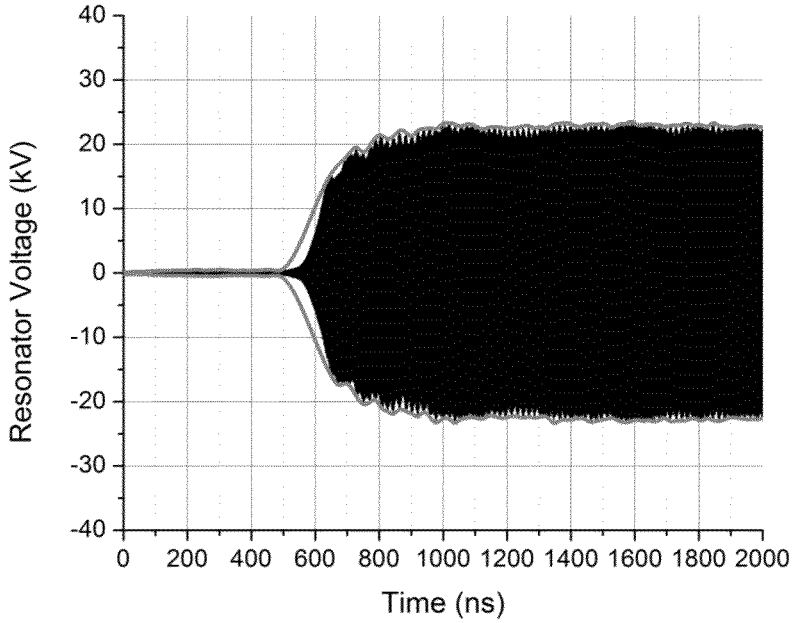
FIG. 14a (Prior Art)
FIG. 14*a* is a plot of the voltage (ICEPIC simulations) inside one of the resonators of the CTL CWM 75/100L magnetron with the solid cathode of FIG. 4 (prior art).
Figure 14B:
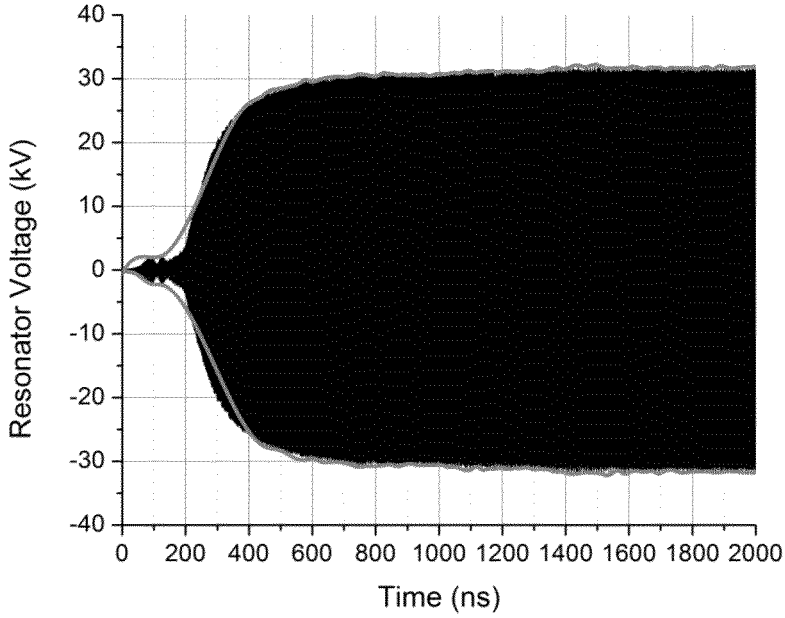
FIG. 14b (Prior Art)
FIG. 14*b* is a plot of the voltage (ICEPIC simulations) inside one of the resonators of the CTL CWM 75/100L magnetron with the transparent cathode of FIG. 7 (prior art).
Figure 14C:
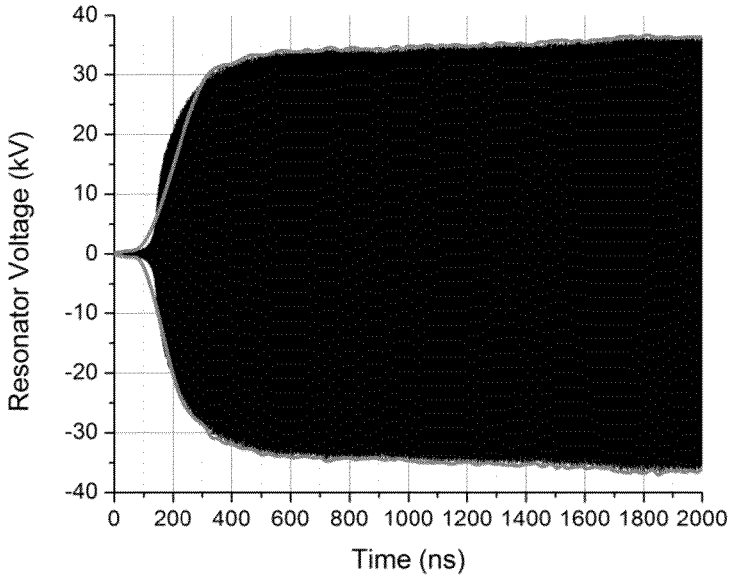
FIG. 14*c* is a plot of the voltage (ICEPIC simulations) inside one of the resonators of the CTL CWM 75/100L magnetron with the metamaterial rodded cathode of FIG. 3, 10.
Figure 15A:
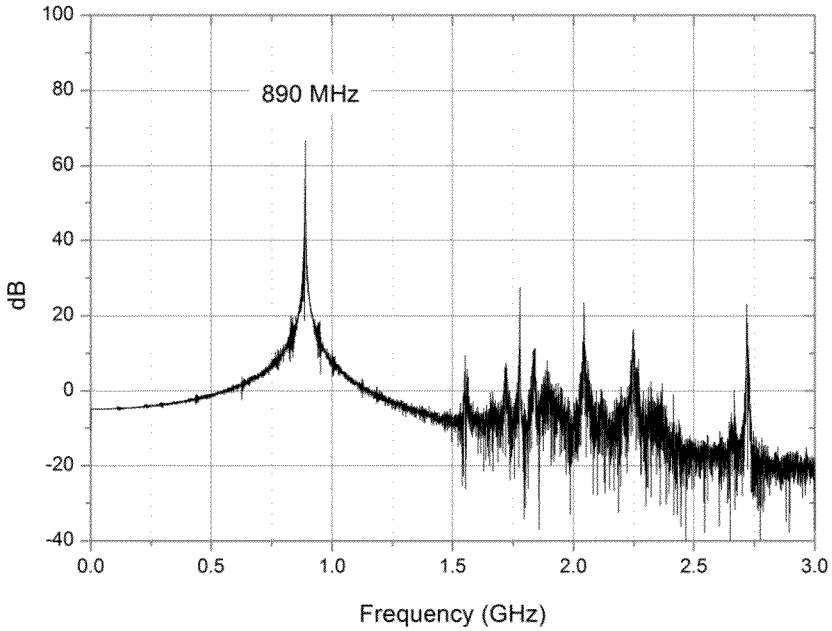
FIG. 15a (Prior Art)
FIG. 15*a* is a plot of the frequency spectra of the output voltage (ICEPIC simulations) at one of the output ports of the CTL CWM 75/100L magnetron with the solid cathode of FIG. 4 (prior art).
Figure 15B:
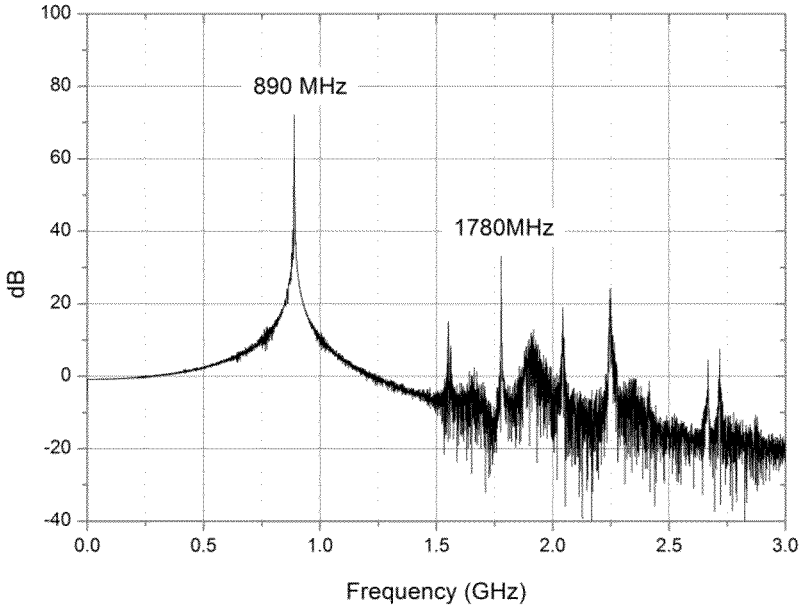
FIG. 15b (Prior Art)
FIG. 15*b* is a plot of the frequency spectra of the output voltage (ICEPIC simulations) at one of the output ports of the CTL CWM 75/100L magnetron with the transparent cathode of FIG. 7 (prior art).
Figure 15C:
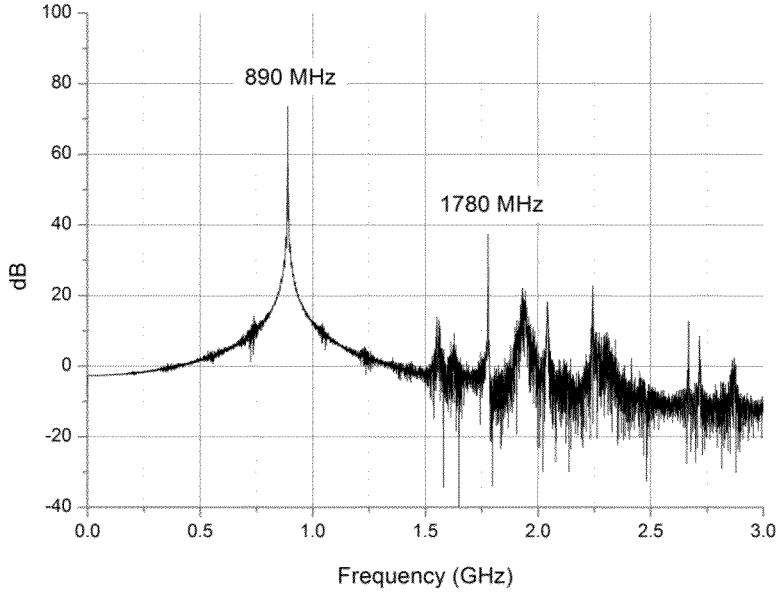
FIG. 15*c* is a plot of the frequency spectra of the output voltage (ICEPIC simulations) at one of the output ports of the CTL CWM 75/100L magnetron with the metamaterial rodded cathode of FIG. 3, 10.

Results of the simulations are demonstrated by particle plots in the steady-state phase of the magnetron operation (1000 ns), traces of the anode current (FIG. 12), the output power (FIG. 13), the resonator voltage (FIG. 14), and the frequency spectra of the output voltage oscillations at one of the output port (FIG. 15).

Figure 11A:
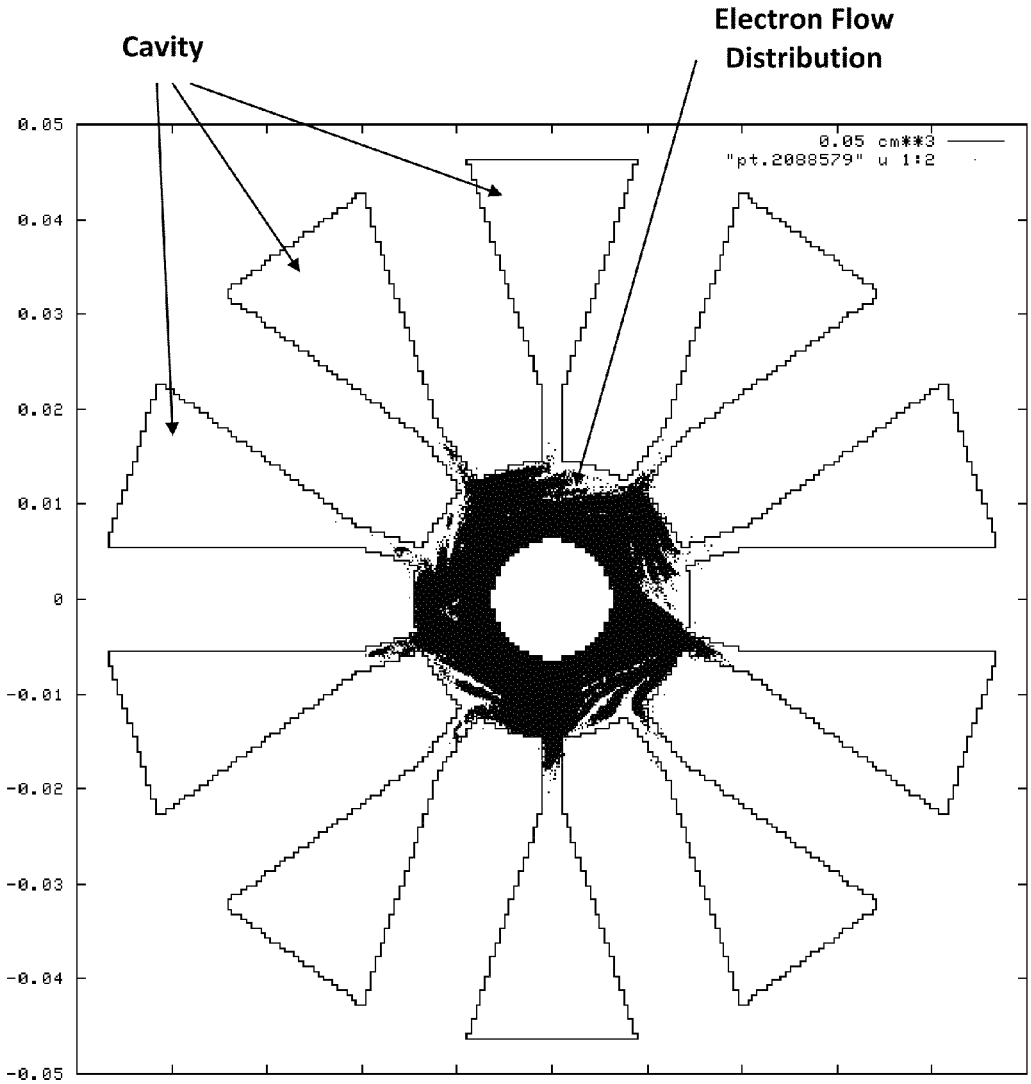
FIG. 11a (Prior Art)
FIG. 11*a* shows a particle plot (ICEPIC simulations) within the resonant system of the CTL CWM 75/100L magnetron with the solid cathode of FIG. 4 (Prior Art).
Figure 11B:
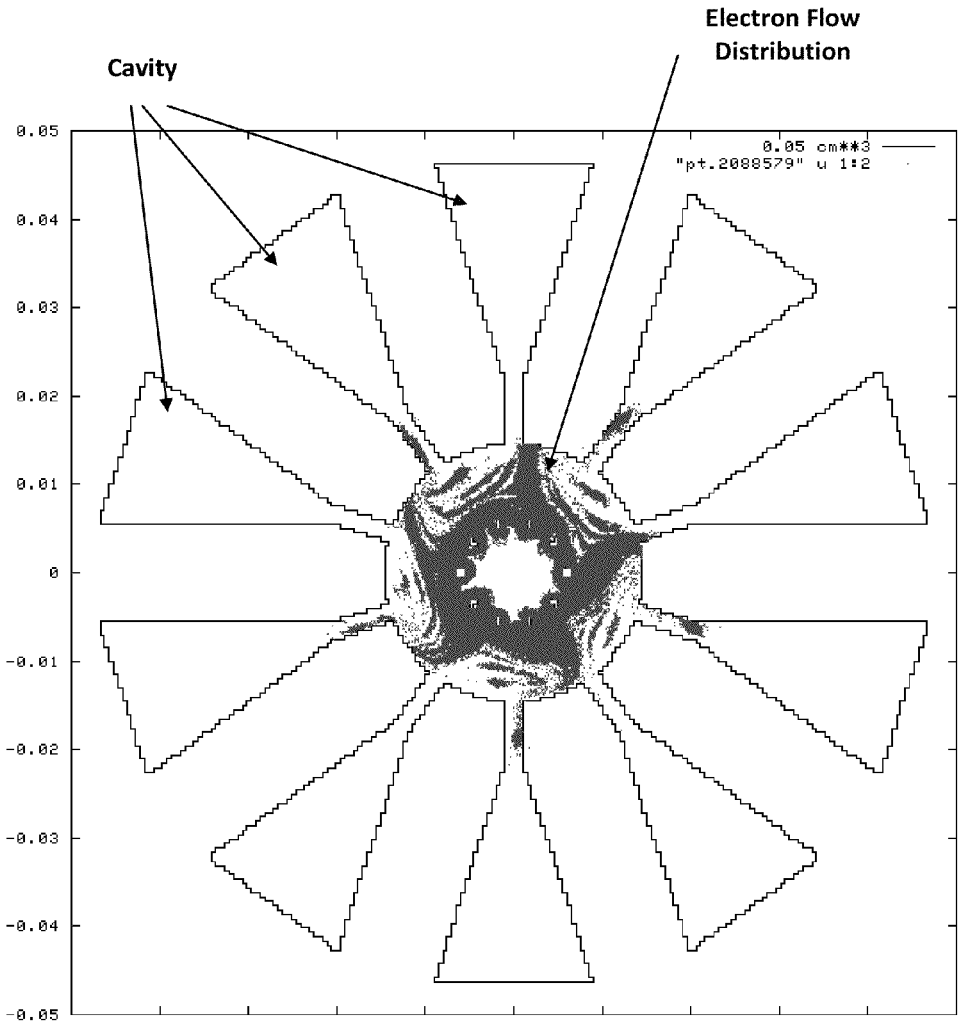
FIG. 11b (Prior Art)
FIG. 11*b* shows a particle plot (ICEPIC simulations) within the resonant system of the CTL CWM 75/100L magnetron with the transparent cathode of FIG. 7 (Prior Art).
Figure 11C:
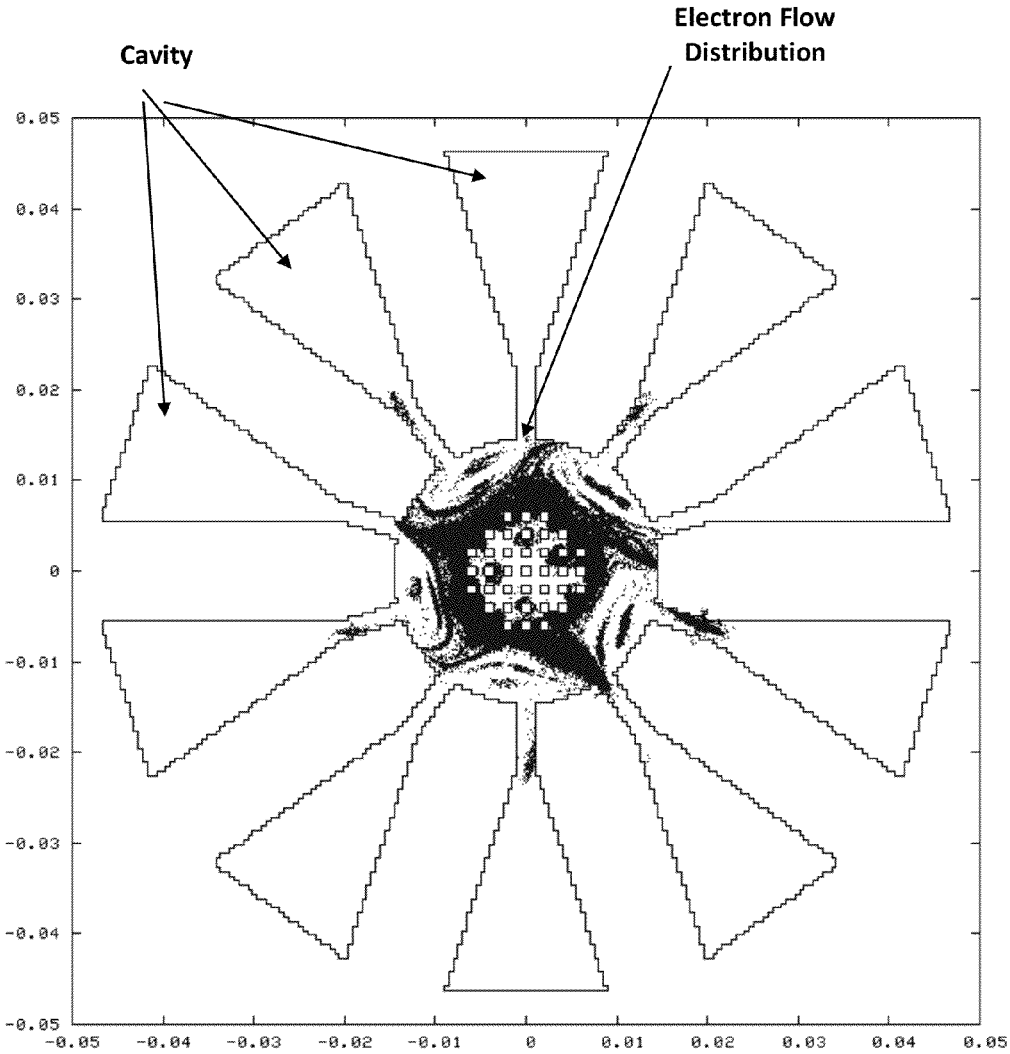
FIG. 11*c* shows a particle plot (ICEPIC simulations) within the resonant system of the CTL CWM 75/100L magnetron with the metamaterial cathode whose metal-thin-wire structures are oriented parallel to the axial component of the induced rf electric field $E_z$ (rodded cathode) of FIG. 3, 10.

Results of the simulations show that with all three cathodes the CTL CWM 75/100L magnetron operates in the same steady-state π mode. The mode of the magnetron operation is recognized by five magnetron spokes (FIG. 11) and the characteristic ~890 MHz frequency of the magnetron operation (FIG. 15). However, there is a significant difference in the amount of the anode current (FIG. 12) and the output microwave power (FIG. 13) when the CTL CWM 75/100L magnetron operates with different cathodes. The highest anode current, Ia~23.1 A (FIG. 12*c*), and the output power, Pout~819.7 kW (FIG. 17), are achieved when the CTL CWM 75/100L magnetron operates with the quasi-metamaterial rodded cathode (FIG. 3 and FIG. 10). Analysis of the simulation results suggests that this effect is caused by the increase of the amplitude of the induced rf oscillations (resonator voltage FIG. 14*c*) within the resonant cavity of the magnetron and not by the increase of the emission area.

Figure 16:
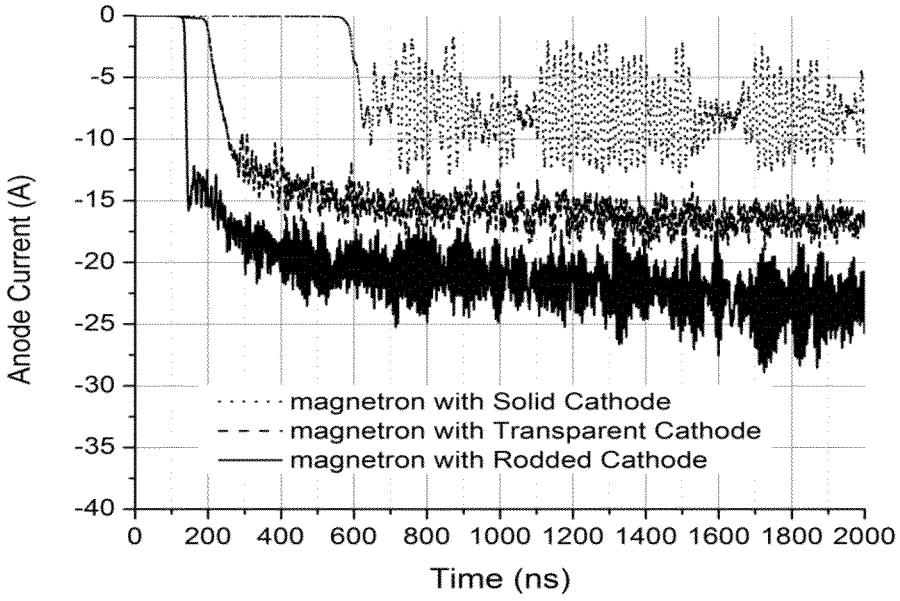
FIG. 16 is a plot of the smoothed anode current (ICEPIC simulations) of the CTL CWM 75/100L magnetron with three different cathodes.
Figure 17:
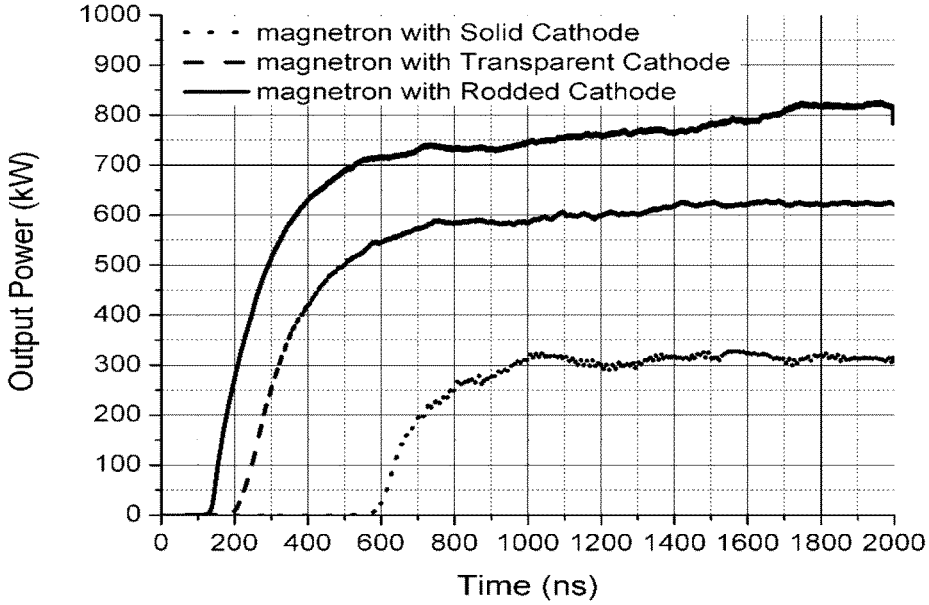
FIG. 17 is a plot of the smoothed output power (ICEPIC simulations) of the CTL CWM 75/100L magnetron with three different cathodes.
Figures 18, 19:
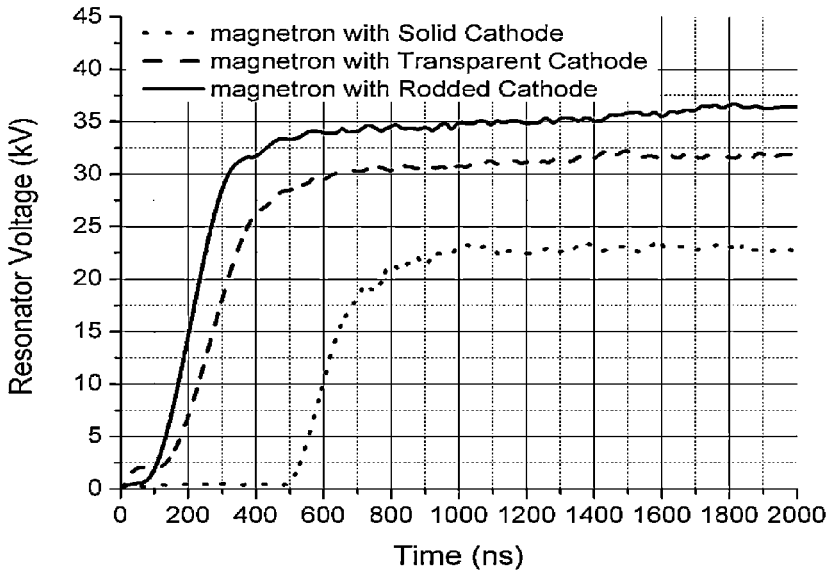
FIG. 18 is a plot of the smoothed resonator voltage (ICEPIC simulations) of the CTL CWM 75/100L magnetron with three different cathodes.
FIG. 19 is a table showing the steady-state output parameters (ICEPIC simulations) of the CTL CWM 75/100L magnetron operating with different cathodes.

Results of the simulations are summarized in FIG. 16 showing the smoothed anode current, FIG. 17 showing the smoothed output power, FIG. 18 showing the envelope of the resonator voltage, and the table of FIG. 19 showing the steady-state output parameters of the CTL CWM 75/100L magnetron operating with different cathodes.

The invention claimed is:

1. A metamaterial cathode designed for a multi-cavity magnetron, said magnetron being considered as a cylindrical magnetron diode with a centrally located electron-emitting metamaterial cathode being symmetrical with respect to the longitudinal axis and being surrounded by a symmetrical anode having a plurality of resonant cavities, an external DC electric field E0 directed radially from the anode to the cathode (−ρ), an external DC magnetic field H0 directed parallel to the longitudinal axis (z), and during operation an induced electromagnetic field (E1×H1) within the magnetron associated with a traveling radio frequency (rf) wave, said induced electromagnetic field having a circumferential component E1Φ, a radial component E1ρ, and an axial component H1z, said magnetron comprised of:

a. a bulk metamaterial cathode of one or more nested helical structures with each helix comprised of a metal-thin-wire with each individual wire directed generally parallel to the circumferential component E1Φ of the induced rf electric field and each helical structure forming a set of metal-split-ring resonators that are generally oriented in a plane perpendicular to the axial component H1z of the induced rf magnetic field, each of said metal-split-ring resonators being electrically connected to each other; and b. said metal-thin-wires having a distance a between two adjacent wires and a wire diameter d with a<λ/4 and d<a where λ is the wavelength of the induced rf electric field, whereby the circumferential component of the induced rf electric field (E1Φ) oscillates along the wires of each helix inducing an artificial electric dipole moment and the axial component of the induced rf magnetic field (H1z) oscillates generally perpendicular to the plane of the split rings inducing an artificial magnetic dipole moment within the body of the metamaterial cathode which either constructively or negatively interacts with the induced E1×H1 field modifying the stop/pass band locations on the dispersion diagram of the magnetron resonant system and thereby improving the output characteristics of said multi-cavity magnetron.

2. The metamaterial cathode designed for a multi-cavity magnetron of claim 1, whereby said cathode is comprised of or covered by a specially developed explosive-emission-friendly and highly conductive material.

3. The metamaterial cathode designed for a multi-cavity magnetron of claim 1, whereby said cathode is comprised of or covered by graphite.

4. The metamaterial cathode designed for a multi-cavity magnetron of claim 1, whereby said cathode is comprised of or covered by carbon fiber.

5. The metamaterial cathode designed for a multi-cavity magnetron of claim 1, whereby a is approximately 0.2 cm, d is approximately 0.1 cm and λ is approximately 33.7 cm.

6. A metamaterial cathode designed for a multi-cavity magnetron, said magnetron being considered as a cylindrical magnetron diode with a centrally located electron-emitting metamaterial cathode being symmetrical with respect to the longitudinal axis and being surrounded by a symmetrical anode having a plurality of resonant cavities, an external DC electric field E0 directed radially from the anode to the cathode (−ρ), an external DC magnetic field H0 directed parallel to the longitudinal axis (z), and during operation an induced electromagnetic field (E1×H1) within the magnetron associated with a traveling radio frequency (rf) wave, said induced electromagnetic field haying a circumferential component E1Φ, a radial component E1ρ, and an axial component H1z, said magnetron comprised of:

a. a bulk metamaterial cathode comprised of a plurality of individual elements with each individual element comprised of a metal-thin-wire directed from the central cathode toward the anode in the radial direction; and b. said metal-thin-wires having a distance a between two adjacent wires and a wire diameter d with $a<\lambda/4$ and $d<a$ where λ is the wavelength of the induced rf electric field.

7. The metamaterial cathode designed for a multi-cavity magnetron of claim 6, whereby said cathode is comprised of or covered by a specially developed explosive-emission-friendly and highly conductive material.

8. The metamaterial cathode designed for a multi-cavity magnetron of claim 6, whereby said cathode is comprised of or covered by graphite.

9. The metamaterial cathode designed for a multi-cavity magnetron of claim 6, whereby said cathode is comprised of or covered by carbon fiber.

10. The metamaterial cathode designed for a multi-cavity magnetron of claim 6, whereby a is approximately 0.2 cm, d is approximately 0.1 cm and λ is approximately 33.7 cm.

11. A metamaterial cathode designed for a multi-cavity magnetron, said magnetron being considered as a cylindrical magnetron diode with a centrally located electron-emitting metamaterial cathode being symmetrical with respect to the longitudinal axis and being surrounded by a symmetrical anode having a plurality of resonant cavities, an external DC electric field E0 directed radially from the anode to the cathode (−ρ), an external DC magnetic field H0 directed parallel to the longitudinal axis (z), and during operation an induced electromagnetic field (E1×H1) within the magnetron associated with a traveling radio frequency (rf) wave, said induced electromagnetic field having a circumferential component E1Φ, a radial component E1ρ, and an axial component H1z, said magnetron comprised of:

a. a bulk metamaterial cathode comprised of a plurality of individual elements with each individual element comprised of a metal-thin-wire rod directed parallel to the longitudinal axis of the cathode; and b. said metal-thin-wire rods having a distance a between two adjacent wires and a wire diameter d with $a<\lambda/4$ and $d<a$ where λ is the wavelength of the induced rf electric field.

12. The metamaterial cathode designed for a multi-cavity magnetron of claim 11, whereby said cathode is comprised of or covered by a specially developed explosive-emission-friendly and highly conductive material.

13. The metamaterial cathode designed for a multi-cavity magnetron of claim 11, whereby said cathode is comprised of or covered by graphite.

14. The metamaterial cathode designed for a multi-cavity magnetron of claim 11, whereby said cathode is comprised of or covered by carbon fiber.

15. The metamaterial cathode designed for a multi-cavity magnetron of claim 11, whereby a is approximately 0.2 cm, d is approximately 0.1 cm and λ is approximately 33.7 cm.

* * * * *